United States Patent [19]

Leblanc

[11] 4,385,610

[45] May 31, 1983

[54] FUEL INJECTION PUMP FOR COMBUSTION ENGINES

[75] Inventor: Jean Leblanc, Lyons, France

[73] Assignee: Robert Bosch GmbH, Stuttgart, Fed. Rep. of Germany

[21] Appl. No.: 260,955

[22] Filed: May 6, 1981

[30] Foreign Application Priority Data

May 6, 1980 [DE] Fed. Rep. of Germany ..... 3017276

[51] Int. Cl.[3] ..... F02M 41/02

[52] U.S. Cl. ..... 123/447; 123/449

[58] Field of Search ..... 123/449, 458, 451, 447, 123/446

[56] References Cited

U.S. PATENT DOCUMENTS

| | | | |
|---|---|---|---|
| 2,077,259 | 4/1937 | Planiol | 123/451 |
| 2,385,089 | 9/1945 | Lerner | 123/450 |
| 2,913,986 | 11/1959 | Skipper | 123/450 |
| 3,404,668 | 10/1968 | Eheim et al. | 123/449 |
| 3,438,327 | 4/1969 | Thompson | 123/495 |
| 3,485,225 | 12/1969 | Bailey et al. | 123/449 |
| 3,996,910 | 12/1976 | Noguchi et al. | 123/449 |

FOREIGN PATENT DOCUMENTS

| | | | |
|---|---|---|---|
| 1139068 | 12/1956 | France | 123/449 |
| 902925 | 8/1962 | United Kingdom | 123/451 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump is proposed with an axially displaceable distributor for the purpose of affecting the fuel amount and with a metering piston designed to determine the amount of injected fuel by means of a reservoir with adjustable volume.

8 Claims, 5 Drawing Figures

24
23
21
18
17
19
20
22
I
II
III
IV
10
11
3
6
14
16
13
25
2
5
15
6
3
7
11
12
4
1
8
9

FUEL INJECTION PUMP FOR COMBUSTION ENGINES

BACKGROUND OF THE INVENTION

The invention is directed to improvements in a fuel injection pump having a distributor which is axially displaced to determined the rate of fuel delivery. In a known fuel injection pump of this kind (such as German Pat. No. 1 303 637) the pump distributor is displaced axially by a mechanical rpm regulator for the purpose of determining the amount of fuel delivered, while for the purpose of the adjustment of the onset of the injection, the distributor can be rotated during the longitudinal displacement in relationship to the drive shaft. This apparatus is comparatively wasteful in actual regulation and further disadvantageous in that, because of the rigid arrangement of the regulating or control mechanisms, it is not possible to achieve the precise adjustment to the demands of the combustion engine manufacturers as is desired for, among other things, reductions in the engine noise, in fuel consumption and in emissions content of the exhaust gases.

OBJECT AND SUMMARY OF THE INVENTION

It is a principal object of the invention to provide a fuel injection pump allowing for extremely flexible injection pump control.

It is a further object of the invention to provide a device which satisfies nearly all demands of the manufacturers of combustion engines in regard to engine characteristics such as consumption, temperature, exhaust gas, and the like.

It is yet another object to achieve the foregoing objects with a device which is comparatively small and very flexible.

This invention will be better understood and further objects and advantages thereof will become more apparent from the ensuing detailed description of a preferred embodiment taken in conjunction with the drawings.

BRIEF DESCRIPTION OF THE DRAWINGS

A preferred embodiment of the present invention is depicted in the drawings in a simplified fashion, wherein.

DESCRIPTION OF THE PREFERRED EMBODIMENT

Figure 1:
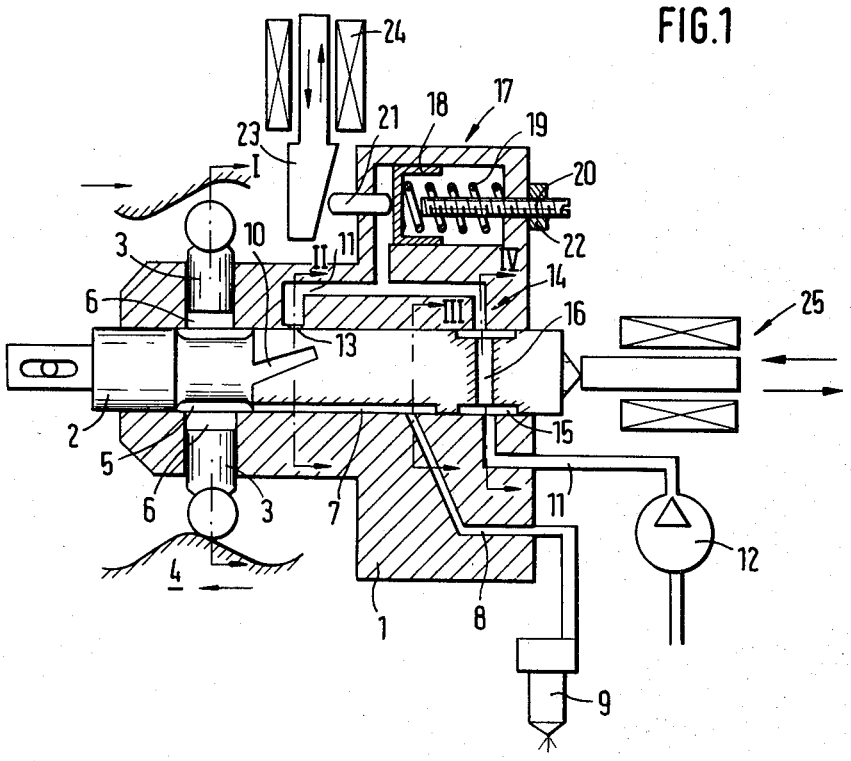
FIG. 1 shows a fuel injection pump according to the present invention in longitudinal cross section, and FIG. 2, in representations A, B, C and D, depicts four different operating positions of the invention, shown respectively by cross sections taken through lines I, II, III and IV in FIG. 1.

A distributor 2 as well as radially disposed pump pistons 3 are fixed in a housing 1. The pump pistons 3 are driven via a cam 4, which clasps the pistons like a casing and is positively connected with the drive shaft of the fuel injection pump (not shown). Via a clutch, also not shown, the distriubtor 2 in engaged by the drive shaft; however, the distriburor 2 is arranged so as to be axially movable in the housing 1. An annular groove 5 is disposed on the jacket face of the distributor 2, which together with the pistons 3 and their associated cylinders delimits the pump work chambers 6. Longitudinal slots are arranged to branch off from this annular groove 5, one of which an elongated longitudinal slot 7, acts together with the pressure lines 8 as distributor slot. The pressure lines 8 lead to the fuel injection nozzles 9 of the combustion engine and are controlled in delivery sequence by the distributing slot 7. Additionally, longitudinal slots 10 are disposed at an angle to the axis of the distributor 2 on the jacket surface thereof, which slots are connected to the annular groove 5 for controlled communication with the extremity of a pressure channel 11 of a fuel supply pump 12. As long as one of the longitudinal slots 10 overlaps the port 13 provided in this pressure channel 11, a direct connection exists between the pump, the pressure channel and the pump work chamber 6. Depending upon the axial disposition of the distributor 2, the moment of the connection between the pressure channel 11 and the pump work chamber 6 can be changed because of the inclination of the longitudinal slot 10 in relation to the drive shaft of the injection pump and thereby to the stroke movement of the pump piston 3. The pressure channel 11 is further controlled by the distributor 2 at a second point 14, where longitudinal slots 15 on the jacket surface of the distributor are connected with each other via a cross bore 16. By moving the distributor 2 axially out of the position shown in FIG. 1, one can block the pressure channel 11 at point 14 during the intake stroke of the pump pistons 3. A reservoir 17 is connected to the pressure channel 11 downstream from this point 14 and upstream from the port 13, in which reservoir a piston 18 is disposed slidingly against a spring 19. The stroke of the piston 18 is limited in one direction during compression of the spring 19 by a first stop 20 and in the other by a slidable stop 21. The stop 20 is adjustable in the housing and can be fixed by the counternut 22. Stop 21, however, is adjustable, based on engine characteristics or randomly, in order to determine the volume to be stored in the reservoir and later to be transported into the pump work chamber 6. The adjustment of the stop 21 is accomplished by means of a tapered cam 23 which is slidably controlled via a magnetic coil 24. The magnetic coil 24 is controlled by an electronic controller in which engine characteristics such as temperature, load, rpms, and the like, forming input values from transducers, are processed into programmed values. During the injection stroke of the fuel injection pump the reservoir is filled by way of the pressure channel 11 and then discharges into the pump work chamber 6 during the suction stroke of the pump pistons 3. During this period of discharge the connection to the supply pump 12 is blocked at point 14.

Alternatively, the axial displacement of the distributor 2 can, as shown symbolically, also be accomplished by an electromagnet 25 also controllable by an electronic controller.

Figure 2:
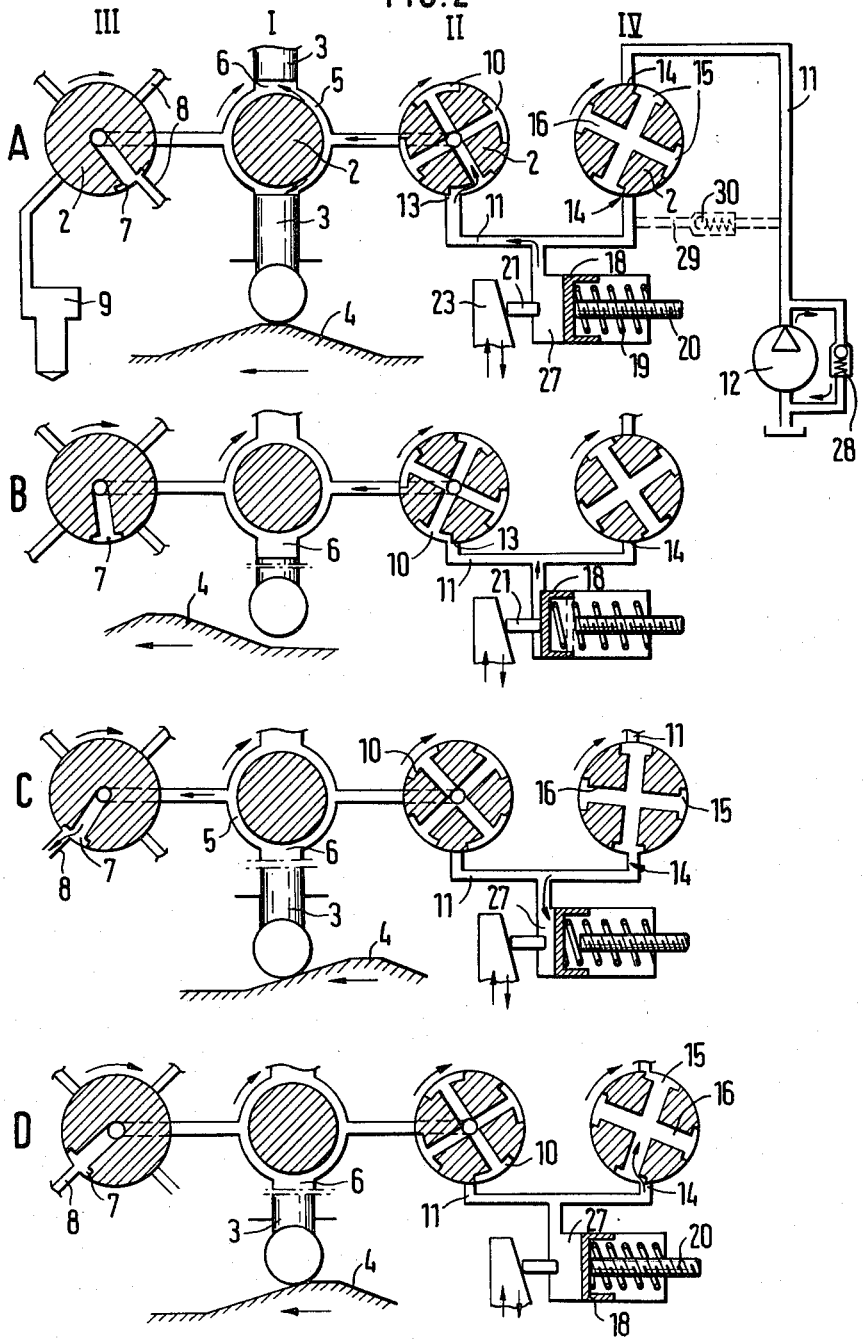

To explain the function more clearly, four different rotational positions of the distributor, A, B, C and D, are depicted in FIG. 2, each shown respectively through sections I, II, III and IV in accordance with the respective lines in FIG. 1. In I the distributor 2 is sectioned in the area of pump piston 3; in II the distributor is sectioned in the area of the port 13; in III the distributor is sectioned in the area in which the pressure lines 8 are controlled by the distributing slot 7; and in IV the distributor is sectioned at point 14 of the pressure channel 11 of the supply pump 12.

In position A the distributor assumes a rotational position where the pump pistons 3 just begin the suction stroke. As shown in view A (II), a connection has just been made via the sloping longitudinal slots 10 between the pressure channel 11 and the pump work chamber 6, so that fuel can enter the pump work chamber 6 from the reservoir 27. At the same time the connection of the pressure channel 11 to pump 12 is blocked at point 14 as shown in A (IV). The distributing slot 7, at A (III), is still overlapping one of the pressure lines 8 in order to achieve a certain relief thereof. The supply pump, in the A (IV) position of the distributor, recirculates fuel via a back-pressure valve 28, which controls the fuel pressure, back to the intake side. To assure that no damage is done in case of overpressure in the channel 11 downstream from point 14, a bypass line 29 with a corresponding high-pressure relief valve 30 is provided.

In position B (I) the cam 4 is disposed so that the pump piston 3, after a corresponding filling of the pump work chamber 6, is raised from the cam, while in view II the longitudinal slot 10 is just passing by the port 13 of the pressure channel 11 so as to close it. Correspondingly, the reservoir piston 18 has come to rest against the second stop 21; the supply function of the reservior piston 18 had already ended in a slightly previous rotational position. At the control point 14 (view IV) the pressure channel 11 is still blocked.

In the rotational position C the pressure stroke of the pump piston 3 has begun in view (I)—note the location of cam 4—so that fuel is fed into the next pressure line 8 (view III) from the pump work chamber 6 via the annular groove 5 and the distributing slot 7. The longitudinal slots 10 are separated from the pressure channel 11 (view II), so that no fuel can move from the pump work chamber 6 to the reservoir 27. However, at point 14 (view IV) the pressure channel 11 is opened via the longitudinal slot 15 and the cross bore 16, so that the reservoir 27 can be filled up to the volume available.

In position D the pump work chamber 6 is just connecting with the pressure channel 11 via the longitudinal slots 10 (view II), so that the remaining fuel supply can flow back into the reservoir 27. If the reservoir piston 18 is already touching the first stop 20, this return-supply fuel can return (view IV) to the supply pump via the control point 14 and the longitudinal slots 15 or the cross bore 16. In case of possible overpressure, the amount of fuel needed can also flow via the bypass 29 and the high-pressure relief valve 30. The pressure stroke of the pump piston 3 here is just about at its end (view I), while the distributing slot 7 still overlaps the pressure line 8 (view III). Axially displacing the distributor 2 merely changes the relative position of the beginning and end of communication between the longitudinal slot 10 (seen here in transverse view) and to the port 13, and, in respect to rotational control of the pump, the moment at which the pressure channel 11 is either opened or closed to communication with the pump work chamber 6.

The foregoing relates to a preferred exemplary embodiment of the invention, it being understood that other embodiments sad variants thereof are possible within the spirit and scope of the invention, the latter being defined by the appended claims.

What is claimed and desired to be secured by letters patent of the United States is:

1. A fuel injection pump for combustion engines provided with a housing having an axially displaceable distributor driven by a pump drive shaft via clutch means, said distributor having a jacket surface which is arranged to control fuel flow, said distributor further having a plurality of slotted zones and arranged to control said fuel flow to pressure lines leading or extending to said engine and a pump work chamber associated with said jacket surface, a pressure channel for fuel supply controlled by said distributor, said pressure channel being connected to a supply pump, further characterized in that a reservoir is connected to said pressure channel, said reservoir defining means for storing an exact quantity of fuel to be injected into said engine, said storing means being controlled by said distributor, said reservoir being filled during an injection stroke of the fuel injection pump and evacuated during a suction stroke of said fuel injection pump toward said pump work chamber.

2. A fuel injection pump for combustion engines provided with a housing having an axially displaceable distributor driven by a pump drive shaft via clutch means, said distributor having a jacket surface which is arranged to control fuel flow, said distributor further having a plurality of slotted zones and arranged to control said fuel flow to pressure lines leading or extending to said engine and a pump work chamber associated with said jacket surface, a pressure channel for fuel supply controlled by said distributor, said pressure channel being connected to a supply pump, further characterized in that a reservoir is connected to said pressure channel, said reservoir having an adjustable volume, said reservoir being controlled by said distributor, said reservoir being filled during an injection stroke of the fuel injection pump and evacuated during a suction stroke of said fuel injection pump toward said pump work chamber, said reservoir including a spring-biased piston having a stroke, said stroke being limited by a first adjustable end stop, said piston further having an initial position predefined by a second end stop, said second end stop being adjustable to set said volume.

3. A fuel injection pump as defined by claim 2, further characterized in that said initial position of the second end stop is adjustable by means of an electric adjusting motor.

4. A fuel injection pump as defined by claim 1, further characterized in that said distributor is axially displaceable by means of an electric adjusting motor.

5. A fuel injection pump as defined by claim 1, further characterized in that said distributor jacket surface includes a control slot at an angle to the axis of said distributor, said control slot serving to control said pressure channel, so that an axial displacement of said distributor control both fuel supplied for the injection stroke and excess fuel returned to the supply pump.

6. A fuel injection pump as defined in claim 1, further characterized in that said pressure channel can be blocked during the suction stroke upstream of the reservoir by means of said distributor.

7. The fuel injection pump of claim 1 wherein said storing means comprise means for metering an exact quantity of fuel to be injected into said engine, said metering means being controlled by said reservoir

8. The fuel injection pump of claim 7 wherein said metering means includes means for delivering said exact quantity to said pump work chamber during the next successive suction stroke of the distributor.

* * * * *